United States Patent [19]

Owens et al.

[11] 3,976,910

[45] Aug. 24, 1976

[54] OPERATING CIRCUIT FOR DISCHARGE LAMPS WITH VOLTAGE STARTING CIRCUIT AND AUXILIARY LIGHTING MEANS THEREFOR

[75] Inventors: Michael Owens, Hendersonville; David W. Knoble, East Flat Rock, both of N.C.

[73] Assignee: General Electric Company, New York, N.Y.

[22] Filed: Mar. 17, 1975

[21] Appl. No.: 558,947

[52] U.S. Cl. ..... 315/92; 315/207; 315/208; 315/242; 315/272; 315/283; 315/DIG. 5

[51] Int. Cl.[2] ..... H05B 37/04; H05B 41/14

[58] Field of Search ..... 315/88, 92, 93, 205–208, 315/240, 243–245, 272, 273, 282, 289, 290, DIG. 2, DIG. 5, DIG. 7

[56] References Cited

UNITED STATES PATENTS

| | | | |
|---|---|---|---|
| 3,466,500 | 9/1969 | Peek | 315/DIG. 7 X |
| 3,496,412 | 2/1970 | Taylor et al. | 315/DIG. 5 X |
| 3,517,254 | 6/1970 | McNamara, Jr. | 315/91 |
| 3,611,432 | 10/1971 | Babcock et al. | 315/92 |
| 3,699,385 | 10/1972 | Paget | 315/DIG. 5 X |
| 3,889,152 | 6/1975 | Bodine, Jr. et al. | 315/DIG. 5 X |

*Primary Examiner*—Siegfried H. Grimm
*Attorney, Agent, or Firm*—Sidney Greenberg

[57] ABSTRACT

Operating circuit for gaseous discharge lamps, such as those of metal vapor type, having a ballast device of conventional type is provided with high voltage generating means for applying high voltage starting pulses on the lamp. The circuit may be combined with an auxiliary incandescent lamp for turning the latter on for safety lighting purposes when the gaseous discharge lamp goes out. The circuit includes an induction coil in series with the gaseous discharge lamp, a controlled switch connected to a tap on the induction coil, and a charging capacitor in series with the controlled switch. When used, the incandescent lamp is connected in series with the controlled switch in parallel with the charging capacitor.

11 Claims, 3 Drawing Figures

OPERATING CIRCUIT FOR DISCHARGE LAMPS WITH HIGH VOLTAGE STARTING CIRCUIT AND AUXILIARY LIGHTING MEANS THEREFOR

The present invention relates to gaseous discharge lamp operating and starting circuits and to such circuits incorporating an auxiliary lighting feature.

It is an object of the invention to provide a simple, reliable and economical starting and operating circuit for gaseous discharge lamps which require high starting voltages.

It is another object of the invention to provide a starting and operating circuit of the above type incorporating an auxiliary lighting circuit for automatically lighting an auxiliary lamp when the gaseous discharge lamp is extinguished.

Still another object of the invention is to provide a combined circuit of the above type wherein the starting circuit and auxiliary lamp automatically cease operation when the gaseous discharge lamp has re-started.

Other objects and advantages will become apparent from the following description and the appended claims.

With the above objects in view, the present invention in one of its aspects relates to a starting and operating circuit for gaseous discharge lamps comprising, in combination, a source of alternating current, induction coil means connected at its input side to the alternating current source, discharge lamp means connected to the output side of the induction coil means, and high voltage starting means including a portion of the induction coil means for providing a high voltage starting pulse on the discharge lamp means, the high voltage starting means comprising a charging capacitor and controlled switch means in series with each other electrically connected to the induction coil means across the alternating current source, and an actuating circuit connected to the controlled switch means for controlling the operation of the same, the actuating circuit being connected to the junction of the induction coil means and the discharge lamp means.

In another aspect of the invention, the circuit includes an auxiliary incandescent lamp connected in series with the controlled switch means in parallel with the charging capacitor.

The invention will be better understood from the following description taken in conjunction with the accompanying drawing, in which.

Figure 1:
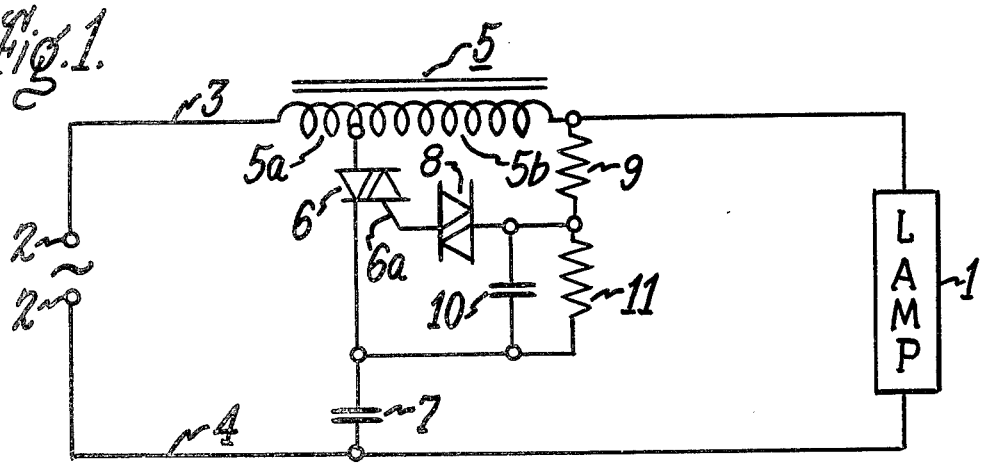
FIG. 1 is a circuit diagram of a discharge lamp starting and operating circuit embodying the present invention.

Referring now to the drawing, and particularly to FIG. 1, there is shown a starting and operating circuit for gaseous discharge lamp 1, such as a sodium or other metal vapor lamp, which requires a relatively high voltage pulse in order to be ignited and which thereafter operates on a lower voltage. Lamp 1 is connected by line conductors 3 and 4 across terminals 2 of an alternating current source, with inductive reactance ballast 5 connected in series therewith to provide a current limiting impedance, as is conventional in discharge lamp circuits. In order to provide high voltage starting pulses, e.g., of 2 to 5 kilovolts, on discharge lamp 1, there is provided in accordance with the invention a high voltage pulse generator comprising controlled switch 6 and charging capacitor 7 connected in series across terminals 2, with controlled switch 6 connected to a tap on ballast coil 5 dividing the latter into coil portions 5*a*, 5*b*.

Controlled switch 6 in the illustrated embodiment is a triac, which is a bilateral (symmetrical) semiconductor switch having a gate electrode 6*a* which, when gated, causes the switch to conduct current in the direction as indicated by the forward bias condition of the semiconductor. Connected to control electrode 6*a* of triac 6 is a symmetrical voltage sensitive switch such as diac 8, which becomes conductive only upon application of a predetermined breakdown voltage. Other types of voltage sensitive switches, such as a neon glow lamp or silicon bilateral switch (SBS), may be used instead of a diac, if desired. A timing circuit for energizing diac 8 and providing for proper phase control of the triac firing so that the lamp starting pulses occur at the optimum time in the alternating current cycle comprises resistor 9 and resistor 11 connected in series across triac 6, with diac 8 connected to the junction of resistor 9 and resistor 11, and timing capacitor 10 connected across resistor 11 and to the junction of triac 6 and charging capacitor 7.

As will be understood, other types of bilateral switching circuits may be used in place of that shown, such as circuits employing oppositely poled SCR's.

Resistor 9 is connected to the junction of ballast coil 5 and discharge lamp 1 and forms with resistor 11 a voltage divider network to produce a voltage of correct magnitude on timing capacitor 10. However, the use of resistor 11 is not always necessary.

In a typical arrangement, the ratio of turns in ballast coil portion 5*a* to those in coil portion 5*b* is about 1:10 to about 1:30, and when controlled switch 6 becomes conductive, the voltage drop across coil portion 5*a*, e.g., 100 to 500 volts, is stepped up by coil 5 acting as an autotransformer to a high voltage, e.g., about 2500 to 5000 volts, which appears across the total reactance turns.

In the operation of the described circuit, and with discharge lamp 1 being off, the voltage supplied by the alternating current source reaches a level at the junction of resistor 9 and resistor 11 at which diac 8 becomes conductive and triggers triac 6 into operation. When triac 6 is turned on, capacitor 7 becomes rapidly charged, e.g., in the order of microseconds, with the charging current passing through ballast coil portion 5*a*. The above described autotransformer action thereby occurs in ballast coil 5 to provide high voltage pulses for igniting lamp 1. The circuit elements are preferably selected such that triac 6 fires near the peak of the line voltage, and resistors 9 and 11 are of sufficiently high resistance to avoid charging of capacitor 7 through those elements. During one-half cycle, capacitor 7 is charged in one direction to the instantaneous (peak) line voltage, then the current goes to zero value and triac 6 turns off. On the next half cycle capacitor 7 is charged in the opposite direction. This alternating sequence continues until the high voltage pulses thereby produced result in starting lamp 1. When lamp 1 starts, the voltage at the junction of resistor 9 and resistor 11 drops to a level which is too low to trigger the operation of diac 8, and accordingly triac 6 does not fire while lamp 1 is on. Should lamp 1 become extinguished, the high voltage generating circuit again becoms operational as above described to re-start lamp 1.

Figure 2:
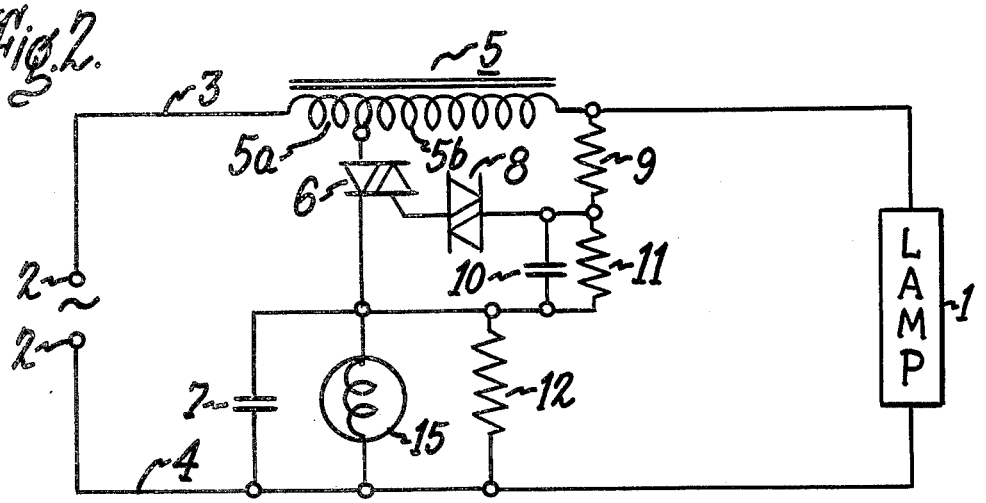
FIG. 2 is a circuit diagram showing a modification of the FIG. 1 circuit incorporating an auxiliary lamp circuit.

FIG. 2 shows an embodiment of the invention incorporating an auxiliary lighting feature. In this embodiment, incandescent lamp 15 is connected in series with triac 6 and in parallel with charging capacitor 7. As will be evident from the previous description, current passing through triac 6 when discharge lamp 1 is out will energize incandescent lamp 15, and the latter will remain energized for a portion of each half cycle until discharge lamp 1 is re-ignited. At that time, triac 6 is turned off and auxiliary lamp 15 becomes inoperative. In this circuit, incandescent lamp 15 serves to remove the charge remaining on capacitor 7 during the time when triac 6 is off. Preferably, resistor 12 is connected across incandescent lamp 15 as shown, so that in the event lamp 15 burns out, resistor 12 may serve to discharge capacitor 7.

In a typical circuit such as shown in FIG. 2, the components listed below will have the following values:

| | |
|---|---|
| Resistor 9 | 270K ohms |
| Resistor 11 | 180K ohms |
| Capacitor 10 | 0.033 microfarads |
| Resistor 12 | 12K ohms |
| Capacitor 7 | 0.22 microfarads |
| Diac 8 | ±32 volt breakdown |

Figure 3:
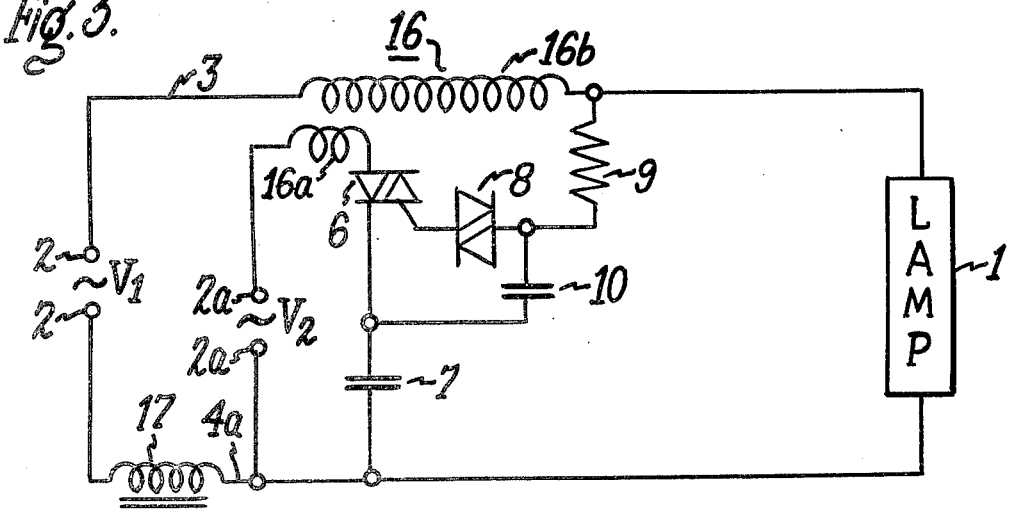
FIG. 3 is a circuit diagram showing a different form of the high voltage generating circuit.

FIG. 3 shows a modification of the described circuit wherein the high voltage generating circuit comprises a pulse transformer 16 having isolated windings **16*a*, 16*b*, with the secondary winding 16*b* in series with alternating current source $V_1$ and discharge lamp 1 and primary winding 16*a* being connected in series with triac 6 and alternating current source $V_2$. Connected in the common supply line 4*a* between sources $V_1$ and $V_2$ is induction coil 17 constituting a ballast reactance for limiting current to discharge lamp 1. In this embodiment, alternating current source $V_1$ provides current for operation of discharge lamp 1, while alternating current source $V_2$ provides current for energizing the high voltage starting circuit comprising triac 6, charging capacitor 7, pulse transformer 16 and associated circuit elements as described above. In this circuit, voltage sources $V_1$ and $V_2$ are synchronized so as to have a predetermined phase relationship, and in an illustrative case, $V_1$ will be 277 volts a-c and $V_2$ will be 120 volts a-c. In this embodiment the flow of current through primary winding 16*a* when triac 6 is turned on will result in a voltage step-up by pulse transformer 16 across secondary winding 16*b* for applying high voltage pulses on discharge lamp 1**.

While transformer windings **16*a*, 16*b*** are isolated from one another as shown, these windings are considered to be electrically connected, as that expression is used herein.

As will be understood, an auxiliary incandescent lamp with parallel connected resistor as shown in FIG. 2 may be incorporated in the FIG. 3 circuit, if desired.

Instead of using symmetrical semiconductor switches as shown, asymmetrical (unilateral) switches may be employed, such as an SCR in place of triac 6 and a Shockley diode or a silicon unilateral switch in place of diac 8.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What we claim as new and desire to secure by Letters Patent of the United States is:

1. A starting and operating circuit for gaseous discharge lamps comprising, in combination, a source of alternating current, induction coil means connected at its input side to said alternating current source, discharge lamp means connected at one side to the output side of said induction coil means and at the other side to said alternating current source, high voltage starting means including a portion of said induction coil means for providing a high voltage starting pulse on said discharge lamp means, said high voltage starting means comprising a charging capacitor and controlled switch means in series with each other electrically connected to said induction coil means across said alternating current source, an actuating circuit connected to said controlled switch means for controlling the operation of the same, said actuating circuit being connected to the junction of said induction coil means and said discharge lamp means, and an auxiliary incandescent lamp connected in series with said controlled switch means and in parallel with said charging capacitor.

2. A starting and operating circuit for gaseous discharge lamps comprising, in combination, a source of alternating current, induction coil means connected at its input side to said alternating current source, discharge lamp means connected at one side to the output side of said induction coil means and at the other side to said alternating current source, high voltage starting means including a portion of said induction coil means for providing a high voltage starting pulse on said discharge lamp means, said high voltage starting means comprising a charging capacitor and controlled switch means in series with each other electrically connected to said induction coil means across said alternating current source, and an actuating circuit connected to said controlled switch means for controlling the operating of the same, said actuating circuit being connected to the junction of said induction coil means and said discharge lamp means, said induction coil means having a plurality of turns and a tap dividing the same into coil portions, said controlled switch means connected at one side to said tap and its other side to said charging capacitor.

3. A starting and operating circuit for gaseous discharge lamps comprising, in combination, a source of alternating current, induction coil means connected at its input side to said alternating current source, discharge lamp means connected at one side to the output side of said induction coil means and at the other side to said alternating current source, high voltage starting means including a portion of said induction coil means for providing a high voltage starting pulse on said discharge lamp means, said high voltage starting means comprising a charging capacitor and controlled switch means in series with each other electrically connected to said induction coil means across said alternating current source, and an actuating circuit connected to said controlled switch means for controlling the operation of the same, said actuating circuit being connected to the junction of said induction coil means and said discharge lamp means, said actuating circuit comprising voltage sensitive switch means connected to said controlled switch means.

4. A circuit as defined in claim 3, said actuating circuit further comprising timing circuit means connected to said voltage sensitive switch means.

5. A circuit as defined in claim 4, said timing circuit means comprising a first resistor and a second capacitor connected in series, said second capacitor connected to the junction of said charging capacitor and said controlled switch means.

6. A circuit as defined in claim 5, said actuating circuit further comprising a second resistor across said second capacitor.

7. A starting and operating circuit for gaseous discharge lamps comprising, in combination, a source of alternating current, induction coil means connected at its input side to said alternating current source, discharge lamp means connected at one side to the output side of said induction coil means and at the other side to said alternating current source, high voltage starting means including a portion of said induction coil means for providing a high voltage starting pulse on said discharge lamp means, said high voltage starting means comprising a charging capacitor and controlled switch means in series with each other electrically connected to said induction coil means across said alternating current source, an actuating circuit connected to said controlled switch means for controlling the operation of the same, said actuating circuit being connected to the junction of said induction coil means and said discharge lamp means, and resistance means connected across said charging capacitor.

8. A circuit as defined in claim 1, and resistance means connected in parallel with said charging capacitor and said auxiliary incandescent lamp.

9. A circuit as defined in claim 3, said controlled switch means comprising a semiconductor switch having a control electrode, said voltage sensitive switch means comprising a semiconductor switch connected to said control electrode.

10. A circuit as defined in claim 2, said coil portions comprising a first coil portion at the input side of said induction coil means and a second coil portion at the output side of said induction coil means, said first coil portion having substantially fewer turns than said second coil portion.

11. A circuit as defined in claim 3, said controlled switch means comprising a symmetrical semiconductor switch having a control electrode, said voltage sensitive switch means comprising a symmetrical semiconductor switch connected to said control electrode.

* * * * *